US009423769B2

(12) United States Patent
Tanaka et al.

(10) Patent No.: US 9,423,769 B2
(45) Date of Patent: Aug. 23, 2016

(54) PROCESS CARTRIDGE

(71) Applicant: Brother Kogyo Kabushiki Kaisha, Nagoya-shi, Aichi-ken (JP)

(72) Inventors: Tokifumi Tanaka, Komaki (JP); Satoru Ishikawa, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/334,860

(22) Filed: Jul. 18, 2014

(65) Prior Publication Data

US 2015/0023692 A1 Jan. 22, 2015

(30) Foreign Application Priority Data

Jul. 19, 2013 (JP) ..... 2013-150925

(51) Int. Cl.
*G03G 21/18* (2006.01)

(52) U.S. Cl.
CPC ..... *G03G 21/1846* (2013.01); *G03G 21/1817* (2013.01); *G03G 2221/1846* (2013.01); *G03G 2221/1853* (2013.01)

(58) Field of Classification Search
CPC ..... G06G 21/1803; G06G 21/1817; G06G 21/1846; G06G 2221/1846; G06G 2221/1853
USPC ..... 399/113
See application file for complete search history.

(56) References Cited

U.S. PATENT DOCUMENTS

| | | | | |
|---|---|---|---|---|
| 7,953,339 | B2 | 5/2011 | Fukamachi et al. | |
| 2006/0245786 | A1* | 11/2006 | Suzuki | 399/111 |
| 2008/0240774 | A1 | 10/2008 | Fukamachi et al. | |
| 2009/0169248 | A1* | 7/2009 | Ishii et al. | 399/111 |
| 2010/0303499 | A1* | 12/2010 | Mori | G03G 21/1846 399/113 |
| 2016/0041519 | A1* | 2/2016 | Sato | G03G 21/1676 399/113 |

FOREIGN PATENT DOCUMENTS

| | | | |
|---|---|---|---|
| JP | 2006-308802 | A | 11/2006 |
| JP | 2008-249802 | A | 10/2008 |

* cited by examiner

*Primary Examiner* — Benjamin Schmitt
(74) *Attorney, Agent, or Firm* — Banner & Witcoff, Ltd.

(57) ABSTRACT

A process cartridge includes an image carrying member cartridge and a developing cartridge. The image carrying member cartridge includes a first handle. The developing cartridge includes a second handle. In a state where the developing cartridge is attached to the image carrying member cartridge, a one edge of the first handle is located at substantially the same position as a one edge of the second handle in a direction, and the second handle is spaced apart from the first handle.

13 Claims, 11 Drawing Sheets

PROCESS CARTRIDGE

CROSS-REFERENCE TO RELATED APPLICATION

This application claims priority from Japanese Patent Application No. 2013-150925, filed on Jul. 19, 2013, which is incorporated herein by reference in its entirety.

TECHNICAL FIELD

Aspects disclosed herein relate to a process cartridge for use in an electrophotographic image forming apparatus.

BACKGROUND

A known process cartridge for use in an electrophotographic image forming apparatus includes, for example, a drum cartridge and a developing cartridge. The drum cartridge includes a photosensitive drum. The developing cartridge includes a developing roller and is configured to be detachably installed in the drum cartridge.

SUMMARY

The drum cartridge and the developing cartridge each may include a handle. In the known process cartridge in which the developing cartridge is installed in the drum cartridge, the handle of the developing cartridge may be positioned over the handle of the drum cartridge.

Nevertheless, this configuration may cause difficulty in reducing a size of such a process cartridge in an upper-lower direction by thickness corresponding to a total thickness of the overlapping handles, i.e., may cause difficulty in making the process cartridge have a thinner body.

Accordingly, aspects of the disclosure provide for a process cartridge whose size in a second direction may be reduced while accessibility to the developing cartridge is ensured.

According to one or more aspects of the disclosure, a process cartridge may include an image carrying member cartridge and a developing cartridge. The image carrying member cartridge may include an image carrying member configured to rotate, and a first frame configured to support the image carrying member at one end portion of the first frame in a first direction perpendicular to an axial direction of the image carrying member and including a first handle at the other end portion of the first frame in the first direction. The developing cartridge may be configured to be attached to the image carrying member cartridge and includes a developing agent carrying member, and a second frame configured to support the developing agent carrying member at one end portion of the second frame in the first direction and including a second handle at the other end portion of the second frame in the first direction. In a state where the developing cartridge is attached to the image carrying member cartridge, a one edge of the first handle in a second direction perpendicular to the axial direction and perpendicular to the first direction may be located at substantially the same position as a one edge of the second handle in the second direction with respect to the second direction. In the state where the developing cartridge is attached to the image carrying member cartridge, the second handle may be spaced apart from the first handle in the first direction.

According to one or more other aspects of the disclosure, a process cartridge may include an image carrying member cartridge and a developing cartridge. The image carrying member cartridge may include an image carrying member and a first handle positioned at an end portion thereof the image carrying member cartridge. The developing cartridge may be configured to be attached to the image carrying member cartridge and includes a developing agent carrying member, a developing agent chamber, and a second handle positioned at an end portion, of a side of the first handle, of the developing cartridge. When the developing cartridge is accommodated in the image carrying member cartridge, the second handle may be spaced apart from the first handle between the image carrying member and the first handle.

According to the aspects of the disclosure, the size of the process cartridge may be reduced in the second direction while accessibility to the developing cartridge is ensured.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

1. Overview of Process Cartridge

Figure 1:
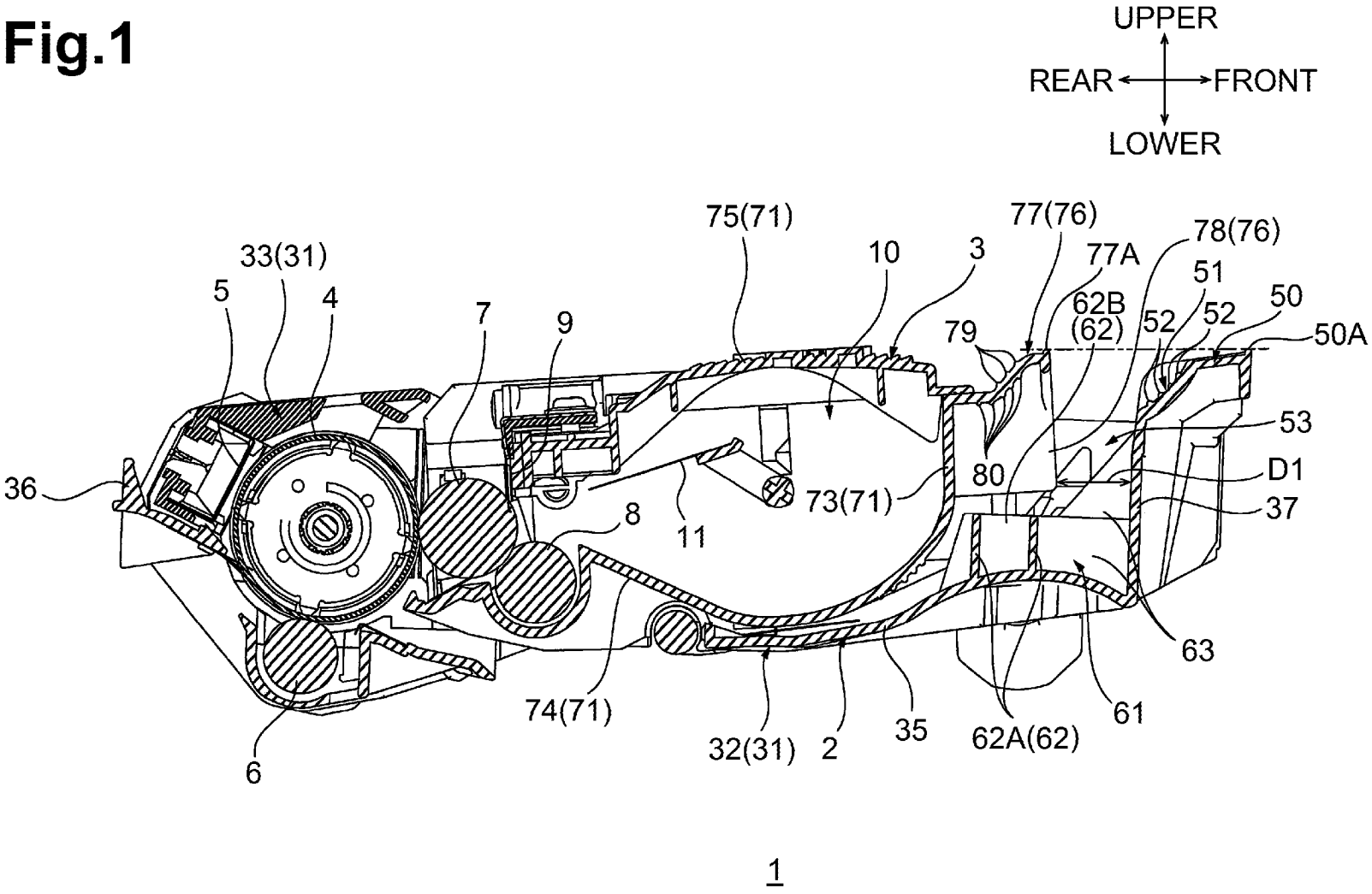
FIG. 1 is a central sectional view depicting a process cartridge including a drum cartridge and a developing cartridge in an illustrative embodiment according to one or more aspects of the disclosure.

As depicted in FIG. 1, a process cartridge 1 includes a drum cartridge 2 and a developing cartridge 3. The drum cartridge 2 is an example of an image carrying member cartridge.

In the description below, an upper-lower direction is defined with reference to an orientation of the process cartridge 1 that is disposed in a horizontal position. That is, the process cartridge 1 depicted in FIG. 1 is disposed in the horizontal position and the orientation of the process cartridge 1 is defined as indicated by arrows in FIG. 1. A right-left direction is defined with respect to the process cartridge 1 as viewed from its front. A right-left direction is an example of an axial direction. A front-rear direction is an example of a first direction. An upper-lower direction is an example of a second direction. A forward direction is an example of one direction of the first direction. A rearward direction is an example of the other direction of the first direction. An upper direction is an example of one direction of the second direction. A lower direction is an example of the other direction of the second direction.

The drum cartridge 2 includes a photosensitive drum 4, a scorotron charger 5, and a transfer roller 6. The photosensitive drum 4 is an example of an image carrying member.

The photosensitive drum 4 is rotatably supported at a rear end portion of the drum cartridge 2.

The scorotron charger 5 is disposed behind the photosensitive drum 4 and spaced apart from the photosensitive drum 4.

The transfer roller 6 is disposed below the photosensitive drum 4. The transfer roller 6 is in contact with a lower end portion of the photosensitive drum 4.

The developing cartridge 3 is installed in the drum cartridge 2 and is positioned in front of the photosensitive drum 4. The developing cartridge 3 includes a developing roller 7, a supply roller 8, a layer-thickness regulating blade 9, and a toner chamber 10. The developing roller 7 is an example of a developing agent carrying member. The toner chamber 10 is an example of a developing agent chamber.

The developing roller 7 is rotatably supported at a rear end portion of the developing cartridge 3. The developing roller 7 is in contact with a front end portion of the photosensitive drum 4.

The supply roller 8 is disposed below and in front of the developing roller 7. The supply roller 8 is rotatably supported by the developing cartridge 3. The supply roller 8 is in contact with a lower-front end portion of the developing roller 7.

The layer-thickness regulating blade 9 is disposed above and in front of the developing roller 7. The layer-thickness regulating blade 9 is in contact with a front end portion of the developing roller 7.

The toner chamber 10 is disposed in front of the supply roller 8 and the layer-thickness regulating blade 9. The toner chamber 10 is configured to store toner therein. Toner is an example of a developing agent. The toner chamber 10 includes an agitator 11.

The agitator 11 is rotatably supported inside the toner chamber 10.

2. Usage of Process Cartridge

Figure 2:
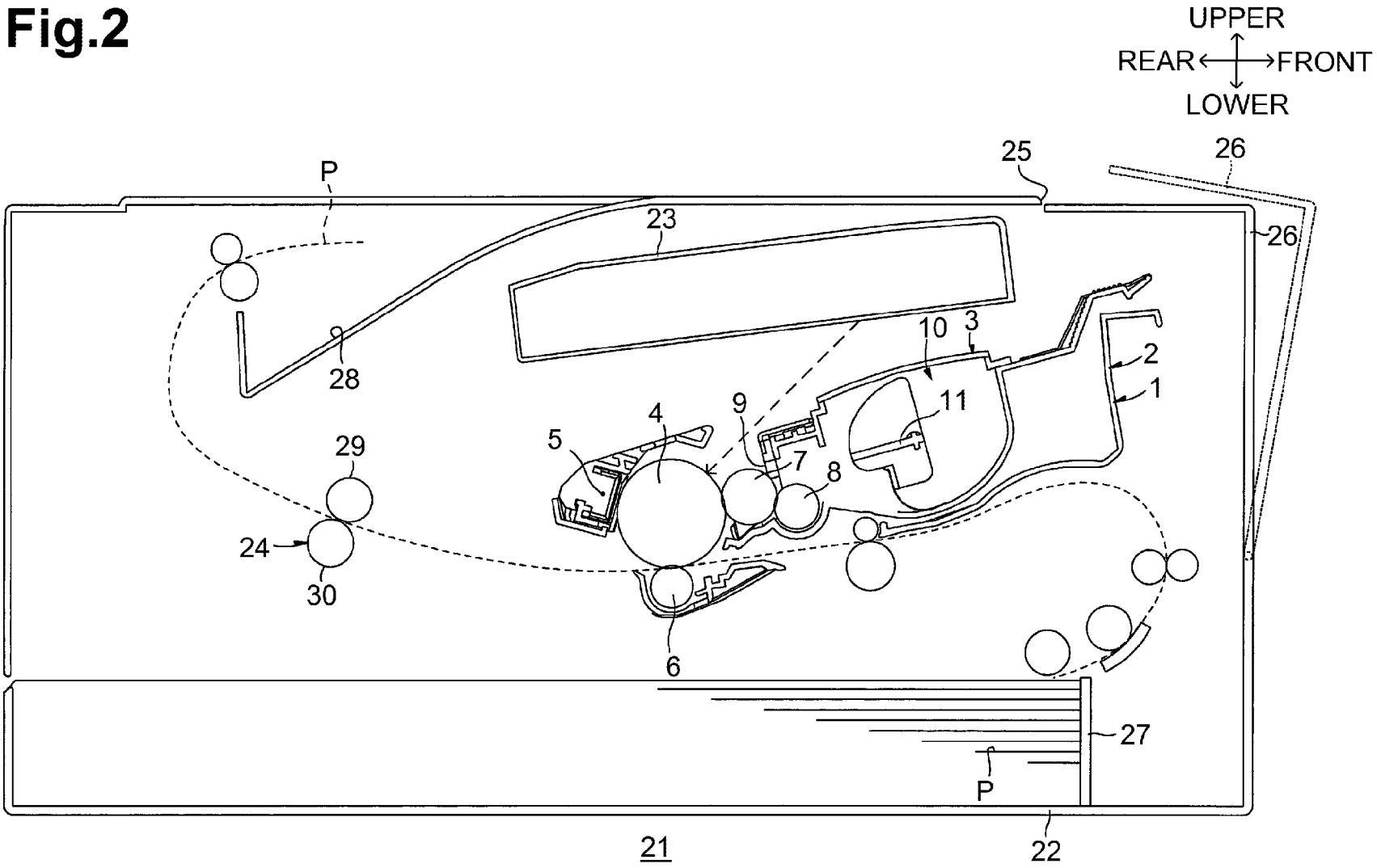
FIG. 2 is a central sectional view depicting an image forming apparatus in which the process cartridge depicted in FIG. 1 is installed in the illustrative embodiment according to one or more aspects of the disclosure.

As depicted in FIG. 2, the process cartridge 1 is configured to be installed in an image forming apparatus 21 and to be used therein.

The image forming apparatus 21 is an electrophotographic monochrome printer. The image forming apparatus 21 includes a main casing 22, the process cartridge 1, a scanner unit 23, and a fixing unit 24.

The main casing 22 has a substantially box shape. The main casing 22 has an opening 25 defined therein and includes a front cover 26, a sheet supply tray 27, and a sheet discharge tray 28.

The opening 25 is defined in a front end portion of the main casing 22. The opening 25 provides communication between the inside and the outside of the main casing 22 in the front-rear direction to allow the process cartridge 1 to pass therethrough.

The front cover 26 is disposed at the front end portion of the main casing 22. The front cover 26 has a substantially flat plate shape. The front cover 26 extends in the upper-lower direction and is supported by a front wall of the main casing 22 so as to be rotatable about its lower end portion. The front cover 26 is configured to expose or close the opening 25.

The sheet supply tray 27 is disposed at a bottom portion of the main casing 22. The sheet supply tray 27 is configured to accommodate therein one or more sheets P.

The sheet discharge tray 28 is disposed at a front half portion of an upper wall of the main casing 22. The sheet discharge tray 28 is recessed than an upper surface of the main casing 22 for supporting one or more sheets P thereon.

The process cartridge 1 is positioned at a substantially middle position of the main casing 22 in the upper-lower direction. The process cartridge 1 is configured to be installed in and detached from the main casing 22.

The scanner unit 23 is disposed above the process cartridge 1. The scanner unit 23 is configured to irradiate the photosensitive drum 4 with a laser beam based on image data.

The fixing unit 24 is disposed behind the process cartridge 1. The fixing unit 24 includes a heat roller 29 and a pressure roller 30. The pressure roller 30 is in pressure contact with a lower-rear end portion of the heat roller 29.

As the image forming apparatus 21 starts an image forming operation, the scorotron charger 5 charges a surface of the photosensitive drum 4 uniformly and the scanner unit 23 exposes the surface of the photosensitive drum 4 with light. Thus, an electrostatic latent image based on image data is formed on the surface of the photosensitive drum 4.

The agitator 11 agitates toner stored in the toner chamber 10 and supplies toner to the supply roller 8. The supply roller 8 further supplies toner to the developing roller 7 from the agitator 11. Meanwhile, toner is positively charged between the developing roller 7 and the supply roller 8 and is then carried by the developing roller 7, and the layer-thickness regulating blade 9 regulates a layer thickness of toner carried by the developing roller 7.

The toner carried by the developing roller 7 is then supplied onto the electrostatic latent image formed on the surface of the photosensitive drum 4. Thus, a toner image is carried by the surface of the photosensitive drum 4.

The sheets P are fed, one by one, to between the photosensitive drum 4 and the transfer roller 6 at a predetermined timing from the sheet supply tray 27 by rotation of the rollers.

The toner image formed on the surface of the photosensitive drum 4 is transferred onto the sheet P while the sheet P passes between the photosensitive drum 4 and the transfer roller 6.

Then, the sheet P is applied with heat and pressure while the sheet P passes between the heat roller 29 and the pressure roller 30, whereby the toner image transferred onto the sheet P is thermally fixed thereon. After the toner image is fixed on the sheet P, the sheet P is discharged onto the sheet discharge tray 28.

3. Details of Drum Cartridge

Figure 3:
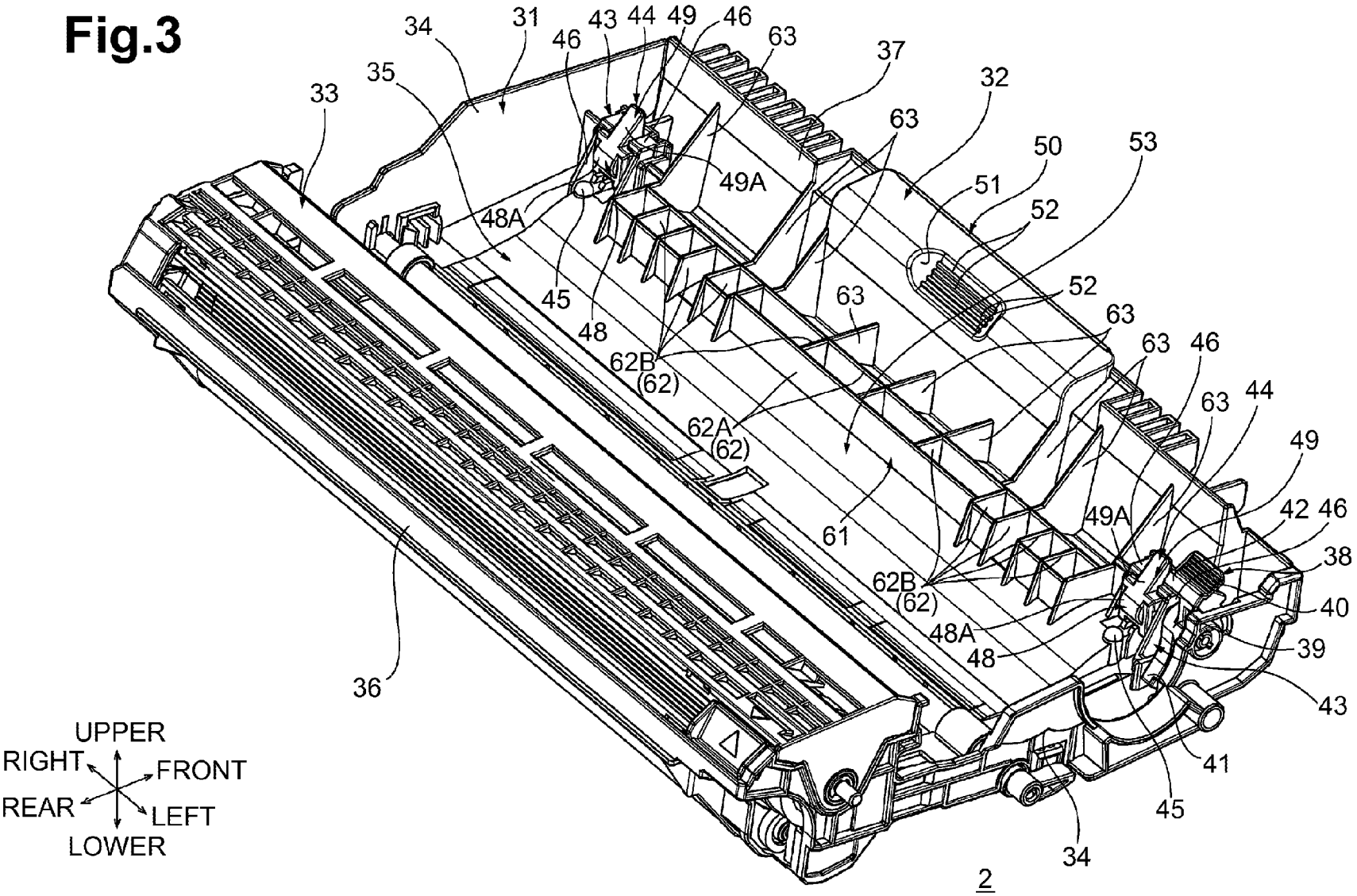
FIG. 3 is an upper rear perspective view depicting the drum cartridge depicted in FIG. 1 in the illustrative embodiment according to one or more aspects of the disclosure.

As depicted in FIGS. 1 and 3, the drum cartridge 2 includes a drum frame 31 that is an example of a first frame.

The drum frame 31 includes a base frame 32 and a cover frame 33.

The base frame 32 has a substantially rectangular shape in plan view and has a bottom. The base frame 32 includes a pair of side walls 34, a bottom wall 35, a rear wall 36, a front wall 37, and a strengthening rib 61 that are integral with each other.

The side walls 34 are disposed at both end portions, respectively, of the bottom wall 35 of the base frame 32 in the right-left direction. The side walls 34 each have a substantially rectangular flat plate shape in side view and extend in the front-rear direction, respectively. The left side-wall 34 includes a lock member 38 that is an example of a regulating member.

The lock member 38 includes a rotating shaft 39, a lever portion 40, and a lifting portion 41 that are integral with each other.

The rotating shaft 39 has a generally cylindrical shape and extends in the right-left direction. A left end portion of the rotating shaft 39 is rotatably supported by a front end portion of the left side-wall 34.

The lever portion 40 extends upward from a right end portion of the rotating shaft 39 beyond an upper edge of the left side-wall 34. The lever portion 40 has a substantially flat plate shape. The lever portion 40 includes a regulating portion 42.

Figure 8A:
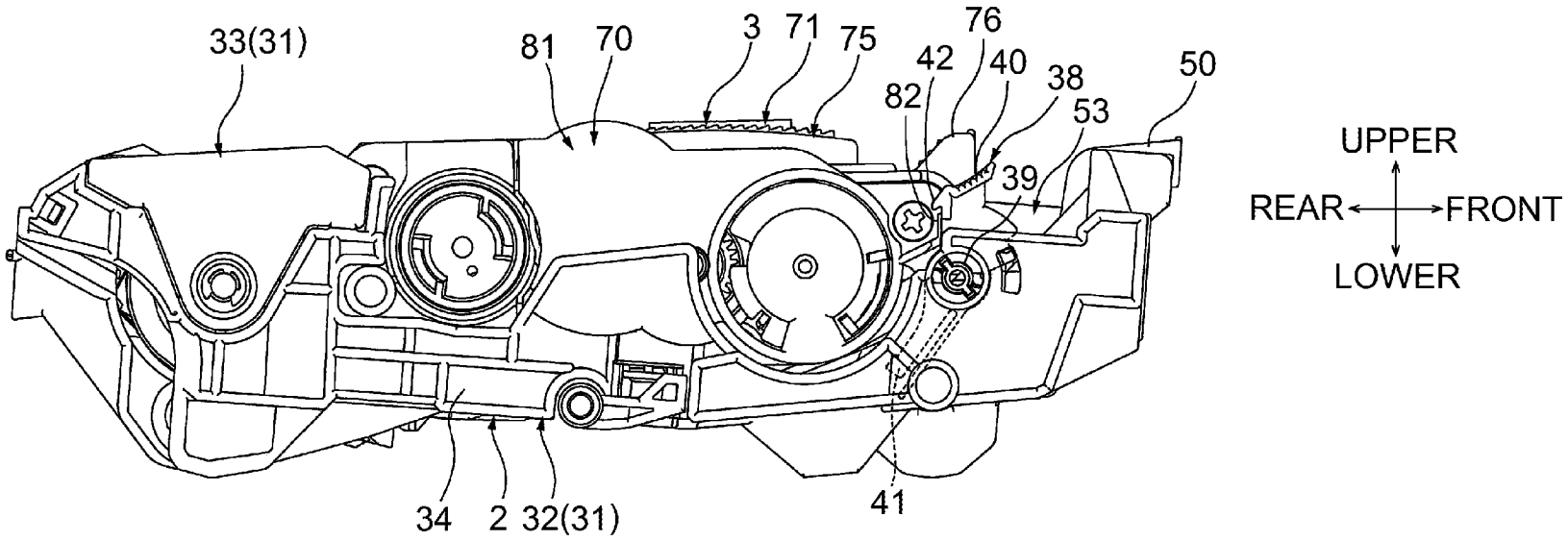
FIG. 8A is an explanatory diagram for explaining one step in a procedure to detach the developing cartridge from the drum cartridge in the illustrative embodiment according to one or more aspects of the disclosure, wherein the developing cartridge is located at the restricted position and a lock member is located at a restricting position.

The regulating portion 42 is disposed at an upper end portion of the lever portion 40 (see FIG. 8A). The regulating portion 42 has a substantially flat plate shape and extends in the right-left direction. A right end portion of the regulating portion 42 protrudes rightward relative to the right end portion of the rotating shaft 39.

The lifting portion 41 extends downward and rearward from the right end portion of the rotating shaft 39. The lifting portion 41 has a substantially rod shape.

The bottom wall 35 is disposed between lower end portions of the side walls 34 and extends in the front-rear direction. The bottom wall 35 has a substantially rectangular flat plate shape in plan view. The bottom wall 35 includes a plurality of, for example, two, pressing-member supporting portions 43, a plurality of, for example, two, pressing members 44, and a plurality of, two, contact protrusions 45.

Figure 7A:
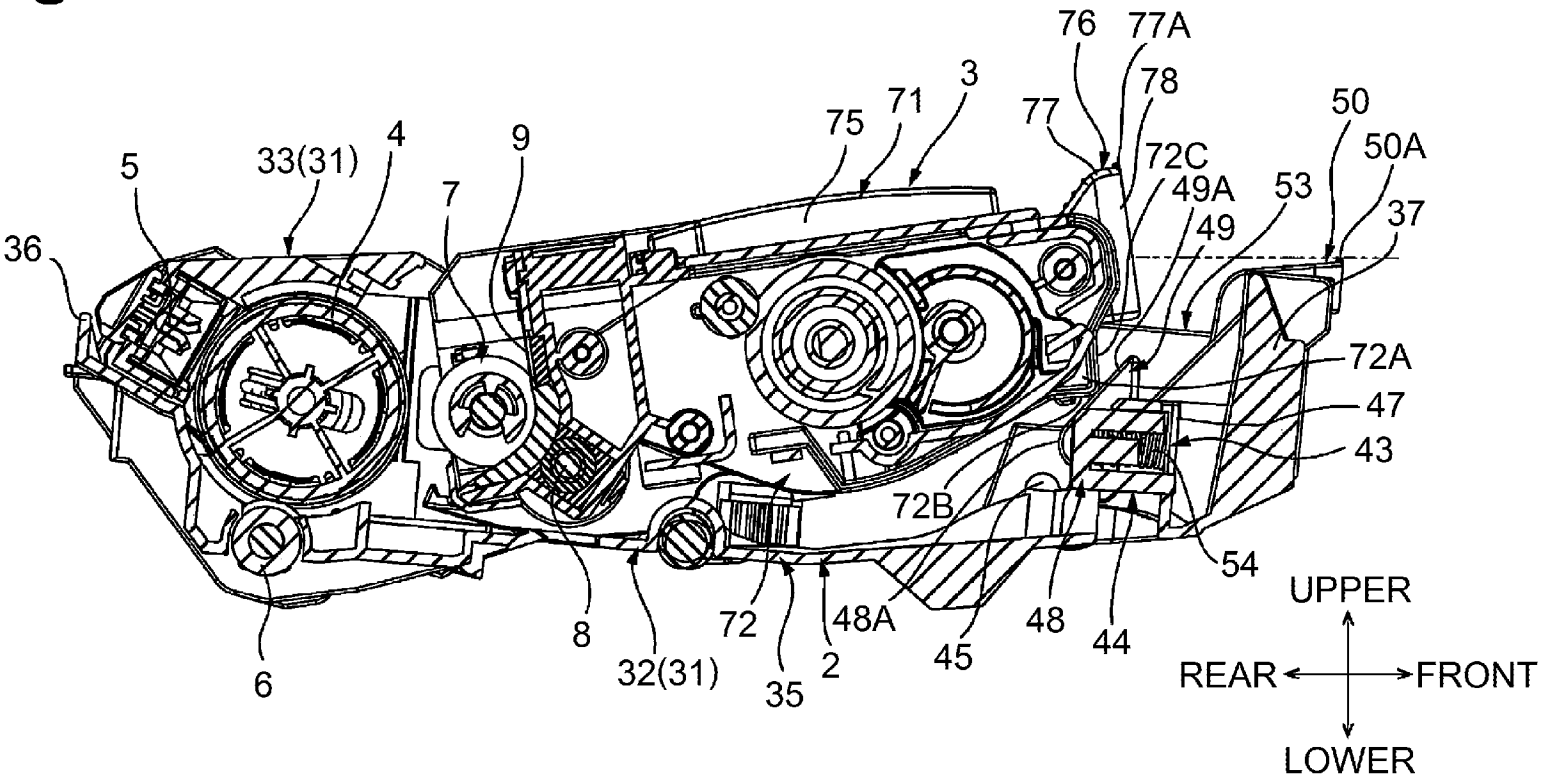
FIG. 7A is a cross-sectional view taken along line A-A in FIG. 6 for explaining one step in a procedure to install the developing cartridge in the drum cartridge in the illustrative embodiment according to one or more aspects of the disclosure, wherein a rear end portion of the developing cartridge is positioned in a developing cartridge mount of the drum cartridge and the developing cartridge is located at a non-restricted position.
Figure 7B:
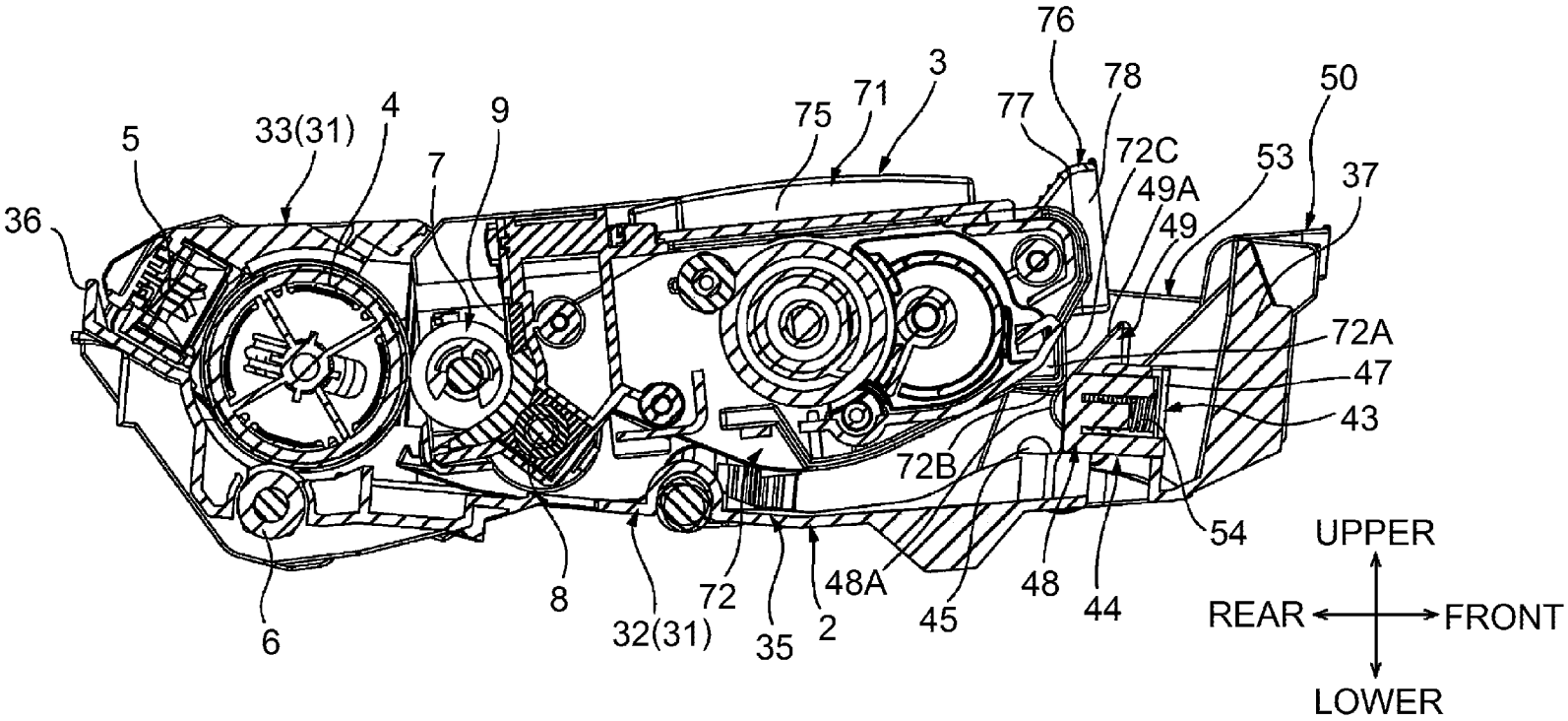
FIG. 7B is a cross-sectional view taken along line A-A in FIG. 6 for explaining another step subsequent to the step of FIG. 7A in the procedure to install the developing cartridge in the drum cartridge in the illustrative embodiment according to one or more aspects of the disclosure, wherein a developing roller is in contact with a photosensitive drum.
Figure 7C:
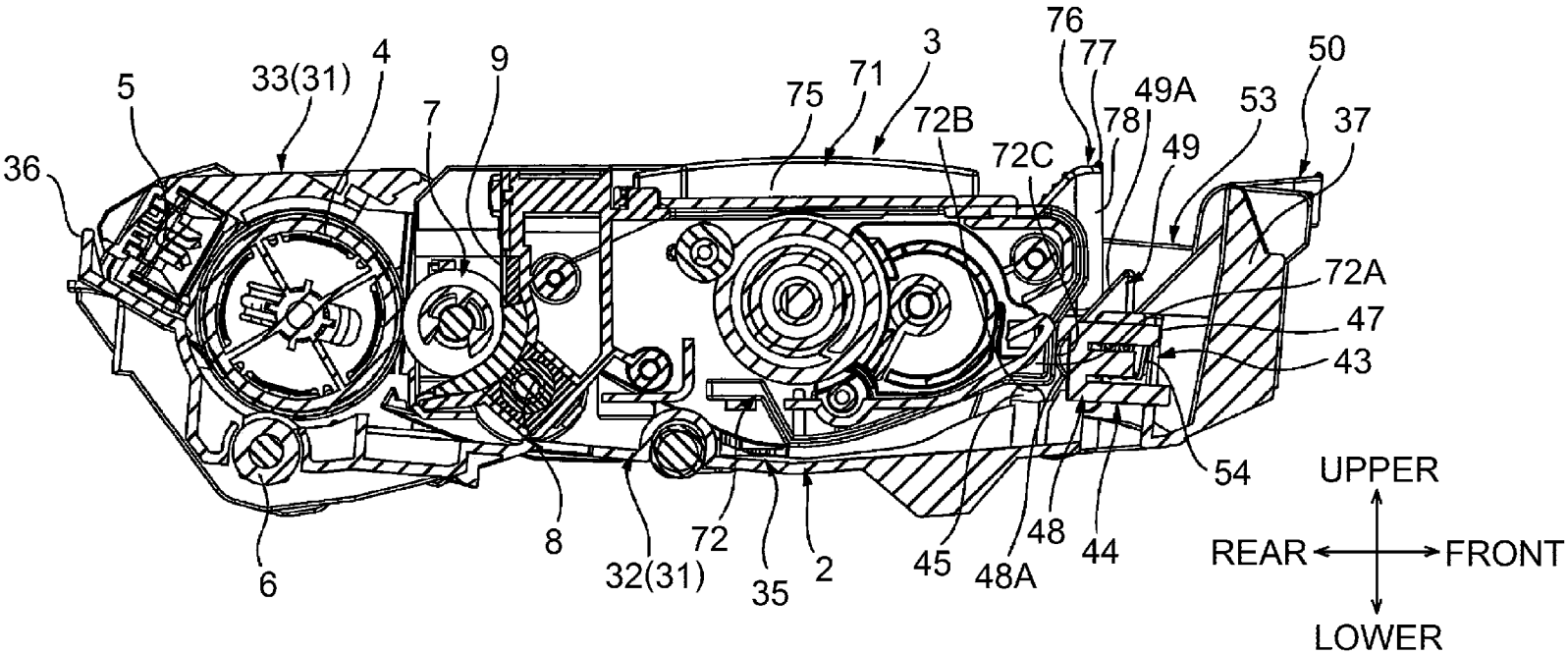
FIG. 7C is a cross-sectional view taken along line A-A in FIG. 6 for explaining other step subsequent to the step of FIG. 7B in the procedure to install the developing cartridge in the drum cartridge in the illustrative embodiment according to one or more aspects of the disclosure, wherein the developing cartridge is installed in the drum cartridge and is located at a restricted position.

As depicted in FIGS. 3 and 7C, the pressing-member supporting portions 43 are disposed at right and left end portions, respectively, of the bottom wall 35. The pressing-member supporting portions 43 each include a pair of side plates 46 and a front plate 47.

In each of the pressing-member supporting portions 43, the side plates 46 are spaced apart from each other in the right-left direction. The side plates 46 each protrude upward from an upper surface of the bottom wall 35. The side plates 46 are bent toward each other and further extend in the right-left direction from their upper ends, respectively, where they are bent.

The front plate 47 is disposed in front of the pair of side plates 46. The front plate 47 protrudes upward from the upper surface of the bottom wall 35.

The pressing member 44 is disposed between the side plates 46 of each of the pressing-member supporting portions 43 so as to be slidable in the front-rear direction. The pressing members 44 have the same configuration and each include a pressing portion 48 and a protruding portion 49.

The pressing portion 48 has a substantially rectangular column shape. The pressing portion 48 extends in the front-rear direction and has a closed rear end. A rear face 48A of the pressing portion 48 has a substantially arc shape in side view. The pressing portion 48 includes a compression spring 54.

The compression spring 54 is disposed inside the pressing portion 48. The compression spring 54 is a coil spring that extends in the front-rear direction. A front end portion of the compression spring 54 is in contact with the front plate 47 of the pressing-member supporting portion 43. A rear end portion of the compression spring 54 is in contact with a rear wall of the pressing portion 48. The compression spring 54 urges the pressing member 44 rearward.

The protruding portion 49 is disposed above the pressing portion 48. The protruding portion 49 has a substantially triangular flat plate shape in side view. The protruding portion 49 extends from a substantially middle portion of the pressing portion 48 in the right-left direction and further extends upward beyond the upper ends of the side plates 46 while passing between the upper end portions of the side plates 46. A rear face 49A of the protruding portion 49 continuously extends to an upper end of the rear face 48A of the pressing portion 48 and is included forward toward the upper direction.

As depicted in FIG. 3, the contact protrusions 45 are disposed behind the pressing-member supporting portions 43, respectively. The contact protrusions 45 each have a substantially semisphere shape. The contact protrusions 45 protrude upward from the upper surface of the bottom wall 35 at the respective positions.

As depicted in FIGS. 1 and 3, the rear wall 36 protrudes upward from a rear end portion of the bottom wall 35 and extends in the right-left direction. The rear wall 36 has a substantially rectangular flat plate shape in front view.

The front wall 37 extends upward continuously from a front end portion of the bottom wall 35. The front wall 37 has a substantially rectangular flat plate shape in front view. Right and left end portions of the front wall 37 are contiguous to the front end portions of the side walls 34, respectively. The front wall 37 includes a drum cartridge handle 50 that is an example of a first handle.

The drum cartridge handle 50 is disposed at a substantially middle portion of the front wall 37 in the right-left direction. The drum cartridge handle 50 has a substantially rectangular flat plate shape in plan view. The drum cartridge handle 50 extends forward from an upper end portion of the front wall 37. The drum cartridge handle 50 has a recess portion 51.

The recess portion 51 is defined in a substantially middle portion of a rear end portion of the drum cartridge handle 50. The recess portion 51 is recessed downward than an upper surface of the drum cartridge handle 50 and is open to the rear. A bottom wall of the recess portion 51 is inclined upward toward the front. The recess portion 51 includes a plurality of ribs 52.

Each of the plurality of ribs 52 slightly protrudes upward from a bottom wall of the recess portion 51 and extends in the right-left direction. The ribs 52 are spaced apart from each other in the front-rear direction.

A strengthening rib 61 is disposed between the pressing-member supporting portions 43. The strengthening rib 61 includes a rib portion 62 and a plurality of connecting portions 63. The plurality of connecting portions 63 is an example of a strengthening portion.

The rib portion 62 is disposed behind the front wall 37 and spaced apart from the front wall 37. The rib portion 62 includes a plurality of first ribs 62A and a plurality of second ribs 62B.

Each of the plurality of first ribs 62A protrudes upward from the bottom wall 35 and extends in the right-left direction. The plurality of first ribs 62A each have a substantially flat plate shape. The first ribs 62A are spaced apart from each other in the front-rear direction.

Each of the plurality of second ribs 62B protrudes upward from the bottom wall 35 and extends in the front-rear direction. The plurality of second ribs 62B each have a substantially flat plate shape. Each second rib portion 62B and each first rib portion 62A intersect with each other and are contiguous to each other. The second ribs 62B are spaced apart from each other in the front-rear direction.

The connecting portions 63 are disposed between the rib portion 62 and the front wall 37. Each of the plurality of connecting portions 63 protrudes upward from the bottom wall 35 and extends in the front-rear direction. The plurality of second ribs 62B each have a substantially flat plate shape. Each of the plurality of connecting portions 63 is contiguous to the rib portion 62 and the front wall 37. Of the plurality of connecting portions 63, one or more connecting portions 63 that are disposed more outside than the drum cartridge handle 50 in the right-left direction each have an upper edge portion that are inclined downward toward the rear.

The cover frame 33 is disposed above a rear end portion of the base frame 32 so as to cover the photosensitive drum 4. The cover frame 33 supports the scorotron charger 5.

In the drum cartridge 2, a portion defined in front of the photosensitive drum 4 by the photosensitive drum 4, the pair of side walls 34, and the front wall 37 serves as a developing cartridge mount 53 where the developing cartridge 3 is to be installed therein.

4. Details of Developing Cartridge

Figure 4:
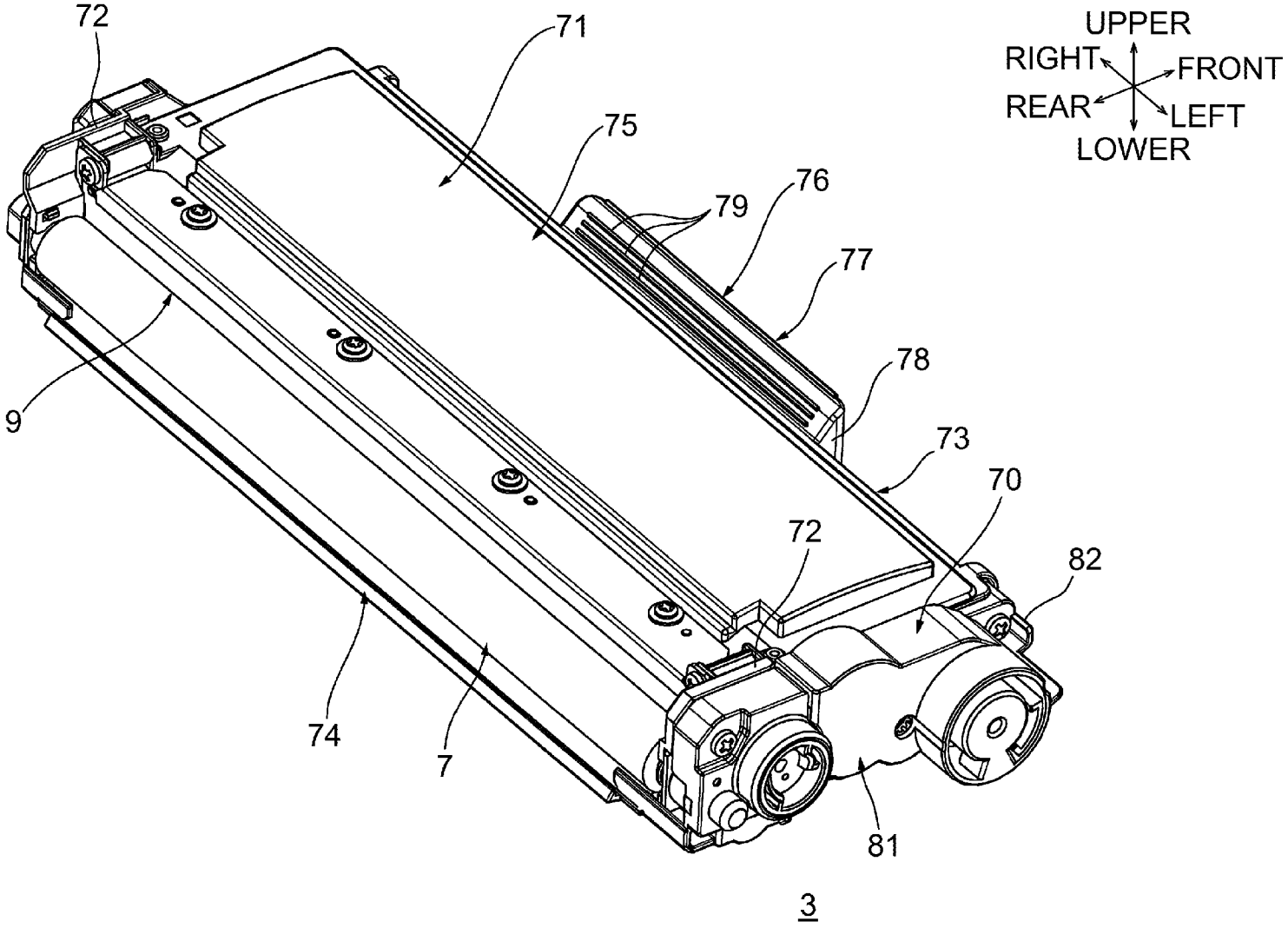
FIG. 4 is an upper rear perspective view depicting the developing cartridge depicted in FIG. 1 in the illustrative embodiment according to one or more aspects of the disclosure.
Figure 5:
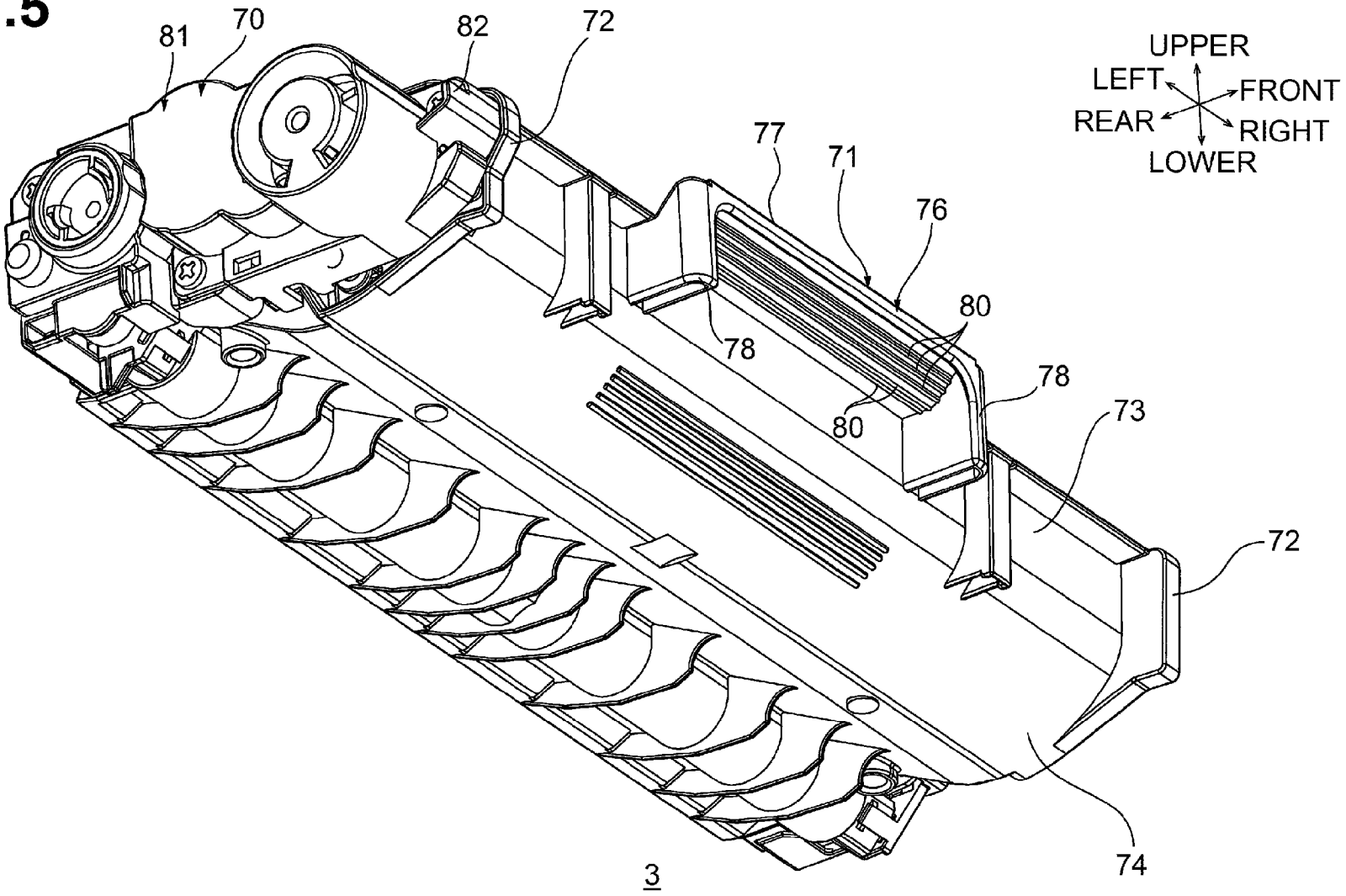
FIG. 5 is a lower front perspective view depicting the developing cartridge depicted in FIG. 4 in the illustrative embodiment according to one or more aspects of the disclosure.

As depicted in FIGS. 4 and 5, the developing cartridge 3 includes a developing frame 71 and a drive portion 70. The developing frame 71 is an example of a second frame.

The developing frame 71 has a substantially box shape. The developing frame 71 includes a pair of side walls 72, a bottom wall 74, a front wall 73, and an upper wall 75.

The side walls 72 are disposed at both end portions, respectively, of the bottom wall 74 of the developing frame 71 in the right-left direction.

The bottom wall 74 has a substantially flat plate shape and extends in the front-rear direction. Right and left end portions of the bottom wall 74 are contiguous to lower end portions, respectively, of the side walls 72.

The front wall 73 is contiguous to a front end portion of the bottom wall 74 and extends upward from the front end portion of the bottom wall 74. The front wall 73 has a substantially rectangular flat plate shape in front view. Right and left end portions of the front wall 73 are contiguous to the front end portions, respectively, of the side walls 72. The front wall 73 includes a developing cartridge handle 76 that is an example of a second handle.

The developing cartridge handle 76 is disposed at a substantially middle portion of an upper end portion of the front wall 73 in the right-left direction. The developing cartridge handle 76 includes an upper plate 77 and side plates 78 that are integral with each other. The upper plate 77 is an example of a first wall and the side plates 78 are an example of a pair of second walls.

The upper plate 77 is disposed at an upper end portion of the developing cartridge handle 76. The upper plate 77 has a substantially rectangular flat plate shape in plan view. The upper plate 77 protrudes forward and upward from the upper end portion of the front wall 73 and extends in the right-left direction. The upper plate 77 is inclined upward toward the front (see FIG. 7C). The upper plate 77 includes a plurality of upper ribs 79 and a plurality of lower ribs 80.

Each of the plurality of upper ribs 79 slightly protrudes upward from an upper surface of the upper plate 77 and extends in the right-left direction. The upper ribs 79 are spaced apart from each other in the front-rear direction.

Each of the plurality of lower ribs 80 slightly protrudes downward from a lower surface of the upper plate 77 and extends in the right-left direction. The lower ribs 80 are spaced apart from each other in the front-rear direction.

The side plates 78 are disposed at right and left end portions, respectively, of the upper plate 77 of the developing cartridge handle 76. The side plates 78 each have a substantially rectangular flat plate shape in side view. Each of the side plates 78 protrudes forward from the front wall 73 of the developing frame 71 and extends in the upper-lower direction. Upper end portions of the side plates 78 are contiguous to right and left end portions, respectively, of the upper plate 77.

The upper wall 75 has a substantially rectangular flat plate shape in plan view. A front end portion of the upper wall 75 is contiguous to the upper end portion of the front wall 73. Right and left end portions of the upper wall 75 are contiguous to the upper end portions, respectively, of the side walls 72.

The drive portion 70 is disposed to the left of the developing frame 71. The drive portion 70 includes a gear train (not depicted) and a gear cover 81 that covers the gear train. The gear train transmits a driving force from the main casing 22 to the developing roller 7, the supply roller 8, and the agitator 11.

The gear cover 81 has a substantially rectangular cylindrical shape and extends in the right-left direction. The gear cover 81 includes a lock portion 82.

The lock portion 82 is disposed at a front end portion of the gear cover 81. The lock portion 82 has a substantially rectangular flat plate shape in front view. The lock portion 82 protrudes leftward from a left surface of the gear cover 81 and extends in the upper-lower direction.

Figure 6:
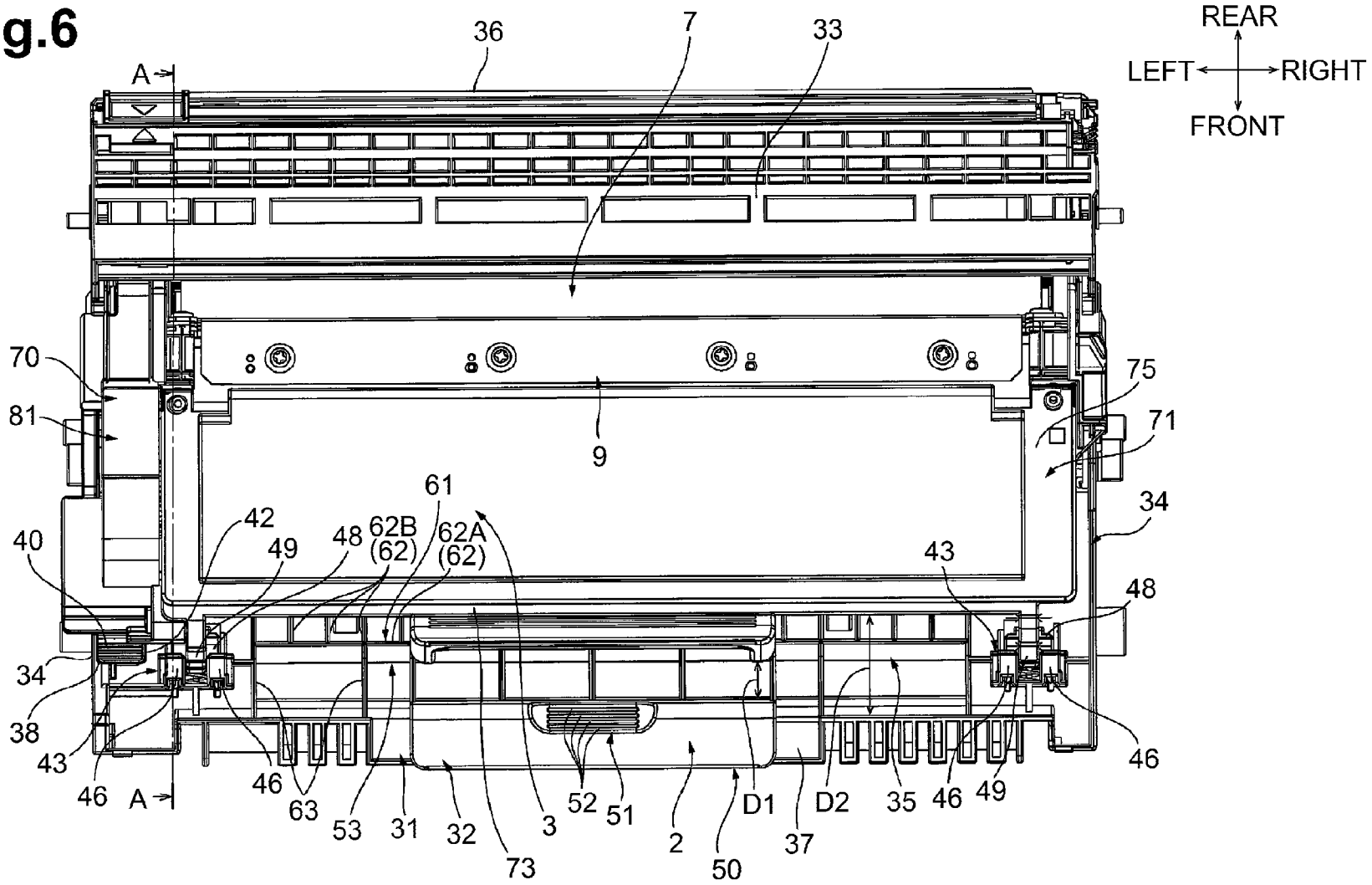
FIG. 6 is a plan view depicting the process cartridge depicted in FIG. 1 in the illustrative embodiment according to one or more aspects of the disclosure.

5. Installation and Detachment of Developing Cartridge in and from Drum Cartridge (1) Installation Procedure of Developing Cartridge in Drum Cartridge As depicted in FIGS. 1 and 6, the developing cartridge 3 is installed in the developing cartridge mount 53 of the drum cartridge 2.

In an installation procedure of the developing cartridge 3 in the drum cartridge 2, an operator holds the developing cartridge handle 76.

When the operator holds the developing cartridge handle 76, for example, the operator holds the upper plate 77 between a thumb and the other fingers such that the index finger, the middle finger, the ring finger and the little finger are in contact with the lower surface of the upper plate 77 with touching the lower ribs 80 and the thumb is in contact with the upper surface of the upper plate 77 with touching the upper ribs 79.

Subsequently, as depicted in FIG. 7A, the operator puts the rear end portion of the developing cartridge 3 into the developing cartridge mount 53 of the drum cartridge 2 from above while holding the developing cartridge handle 76.

In response to this, the front end portions of the side walls 72 of the developing cartridge 3 come into contact with the rear faces 49A of the protruding portions 49 of the pressing members 44, respectively, of the drum cartridge 2 from above.

Subsequent to that, the operator moves his/her hand off the developing cartridge handle 76 and presses the front end portion of the developing cartridge 3 downward and rearward.

In response to this, the developing cartridge 3 moves downward and rearward while the front end portions of the side walls 72 slide over the rear faces 49A of the protruding portions 49 of the pressing members 44, respectively. The position of the developing cartridge 3 that is located after pressed downward and rearward is referred to as a non-restricted position.

As depicted in FIG. 7B, as the developing roller 7 comes into contact with the photosensitive drum 4 from the front, the further downward and rearward movement of the developing cartridge 3 is restricted.

The operator further presses the front end portion of the developing cartridge 3 downward.

In response to this, the developing cartridge 3 rotates about its rear end portion in a clockwise direction in left side view. At that time, the front end portions of the side walls 72 of the developing cartridge 3 move downward while pressing the rear faces 48A of the pressing portions 48 of the pressing members 44, respectively, toward the front.

Then, the pressing members 44 move forward against urging force of the compression springs 54. The front end portions of the side walls 72 slide downward over the rear faces 48A of the pressing portions 48 of the pressing members 44, respectively, and thus are positioned behind the respective pressing members 44.

As depicted in FIG. 7C, as the lower surfaces 72B of the front end portions 72A of the side walls 72 come into contact with the respective contact protrusions 45 of the drum frame 31 from above, the further upward rotation of the developing cartridge 3 is restricted. The position of the developing cartridge 3 that is restricted for the rotation is referred to as a restricted position.

In this state, front faces 72C of the front end portions 72A of the side walls 72 are in contact with the rear faces 48A of the pressing portions 48 of the pressing members 44, respectively.

Thus, the pressing members 44 press the side walls 72, respectively, rearward due to urging force from the compression springs 54. In response to this, the developing roller 7 is pressed against the photosensitive drum 4 by the pressing force from the pressing members 44.

As described above, the developing cartridge 3 is thus installed in the drum cartridge 2.

After the developing cartridge 3 is installed in the drum cartridge 2, as depicted in FIGS. 1 and 6, the front wall 73 of the developing frame 71 is positioned behind the front wall 37 of the drum frame 31 while at least a clearance D1 is left between the front wall 73 of the developing frame 71 and the front wall 37 of the drum frame 31 throughout the right-left direction. More specifically, in the developing frame 71, a portion, where the developing cartridge handle 76 is disposed, of the front wall 73 is located closest to the front wall 37 of the drum frame 31 and behind the front wall 37 of the drum frame 31 while the clearance D1 is left between the front wall 73 of the developing frame 71 and the front wall 37 of the drum frame 31. In the developing frame 71, a portion, where the developing cartridge handle 76 is not disposed and that is disposed more outside than the developing cartridge handle 76 in the right-left direction, of the front wall 73 is located behind the front wall 37 of the drum frame 31 while a clearance D2 is left between the portion of the front wall 73 of the developing frame 71 and the front wall 37 of the drum frame 31. The clearance D2 is greater than the clearance D1.

In this state, the developing cartridge handle 76 of the developing frame 71 is positioned behind the drum cartridge handle 50 of the drum frame 31 so as to face the drum cartridge handle 50 of the drum frame 31 while clearance is left therebetween. As indicated by a double-dotted and dashed line in FIG. 1, an upper edge 77A of the upper plate 77 of the developing cartridge handle 76 of the developing frame 71 is located at substantially the same position in the upper-lower direction as an upper edge 50A of the drum cartridge handle 50 of the drum frame 31.

The pressing members 44 are positioned between the front wall 73 of the developing frame 71 and the front wall 37 of the drum frame 31 in plan view.

The connecting portions 63 of the strengthening rib 61 are also positioned between the front wall 73 of the developing frame 71 and the front wall 37 of the drum frame 31 in plan view.

The rib portion 62 of the strengthening rib 61 is positioned below the lower end portions of the side plates 78 of the developing cartridge handle 76 and faces the lower end portions of the side plates 78 of the developing cartridge handle 76.

(2) Detachment Procedure of Developing Cartridge from Drum Cartridge

As depicted in FIG. 8A, in the state where the developing cartridge 3 is installed in the drum cartridge 2, i.e., in the state where the developing cartridge 3 is located at the restricted position, the regulating portion 42 of the lock member 38 is located above the lock portion 82 of the developing cartridge 3. The position of the lock member 38 that is located above the lock portion 82 of the developing cartridge 3 is referred to as a restricting position. When the lock member 38 is located at the restricting position, the lever portion 40 extends upward from the rotating shaft 39. When the lock member 38 is located at the restricting position, the lifting portion 41 extends rearward and downward from the rotating shaft 39 such that a lower end portion of the lifting portion 41 is positioned below the front end portion of the gear cover 81.

If the front end portion of the developing cartridge 3 moves upward while the lock member 38 is located at the restricting position, the lock portion 82 of the developing cartridge 3 comes into contact with the regulating portion 42 of the lock member 38. Thus, further upward movement of the front end portion of the developing cartridge 3 is restricted, whereby the separation of the developing cartridge 3 from the drum cartridge 2 is restricted.

In a detachment procedure of the developing cartridge 3 from the drum cartridge 2, as a first step, the operator presses the lever portion 40 of the lock member 38 forward and downward.

In response to this, the lock member 38 rotates about the rotating shaft 39 in the clockwise direction in left side view. As the lock member 38 rotates in the clockwise direction, a lower-rear end portion of the lifting portion 41 comes into contact with the front end portion of the gear cover 81 from below while the regulating portion 42 moves inclinatory forward to the front of the lock portion 82 of the developing cartridge 3.

The operator further presses the lever portion 40 of the lock member 38 downward and forward.

Figure 8B:
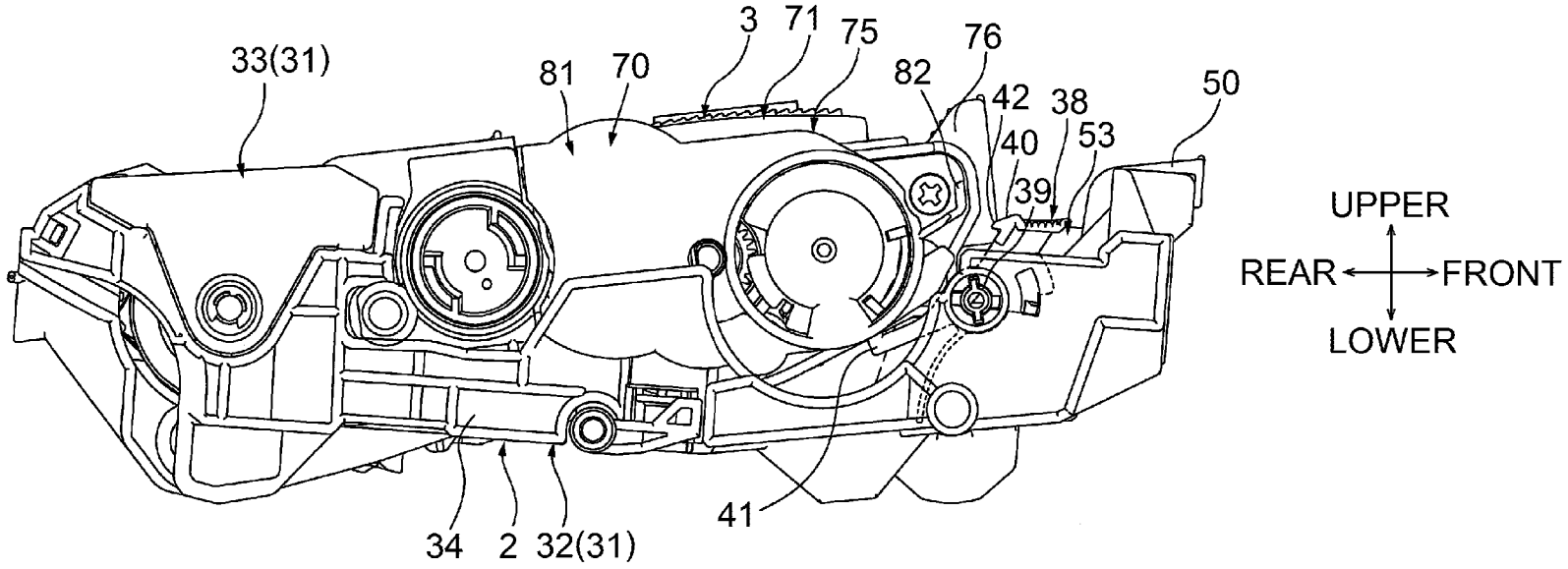
FIG. 8B is an explanatory diagram for explaining another step subsequent to the step of FIG. 8A in the procedure to detach the developing cartridge from the drum cartridge in the illustrative embodiment according to one or more aspects of the disclosure, wherein the developing cartridge is located at the non-restricted position and the lock member is located at a non-restricting position.

In response to this, as depicted in FIG. 8B, the gear cover 81 is pressed upward by the lifting portion 41 and the front end portion of the developing cartridge 3 thus moves upward.

The position of the lock member 38 that is located under this situation is referred to as a non-restricting position.

At that time, as depicted in FIG. 7A, the front end portions 72A of the side walls 72 of the developing cartridge 3 are in contact with the rear faces 49A of the protruding portions 49 of the pressing members 44 of the drum cartridge 2, respectively, from above. Thus, the developing cartridge 3 is supported while the front end portion of the developing cartridge 3 is positioned at an upper position. The position of the developing cartridge 3 under this situation is referred to as a non-restricted position.

At that time, as indicated by a double-dotted and dashed line in FIG. 7A, the upper edge 77A of the upper plate 77 of the developing cartridge handle 76 of the developing frame 71 is located at a higher position than the upper edge 50A of the drum cartridge handle 50 of the drum frame 31.

Subsequently, the operator holds the developing cartridge handle 76.

At that time, to hold the developing cartridge handle 76, for example, the operator inserts his/her index finger, middle finger, ring finger and little finger into between the drum cartridge handle 50 and the developing cartridge handle 76, and holds the upper plate 77 between the thumb and the other fingers such that the index finger, the middle finger, the ring finger and the little finger are in contact with the lower surface of the upper plate 77 with touching the lower ribs 80 and the thumb is in contact with the upper surface of the upper plate 77 with touching the upper ribs 79 as described above.

Subsequent to this, while holding the developing cartridge handle 76, the operator pulls up the developing cartridge 3 from the developing cartridge mount 53 of the drum cartridge 2 to separate the developing cartridge 3 from the drum cartridge 2.

As described above, the drum cartridge 2 is thus completely detached from the developing cartridge 3.

6. Installation and Detachment of Process Cartridge in and from Main Casing

For installing or detaching the drum cartridge 2 in which the developing cartridge 3 is installed, i.e., the process cartridge 1, in or from the main casing 22, the operator holds the drum cartridge handle 50.

When the operator holds the drum cartridge handle 50, for example, the operator holds the drum cartridge handle 50 between the thumb and the other fingers such that the index finger, the middle finger, the ring finger and the little finger are in contact with the lower surface of the drum cartridge handle 50 and the thumb is in contact with the bottom surface of the recess portion 51 of the drum cartridge handle 50 with touching the ribs 52.

As depicted in FIG. 2, the operator opens the front cover 26 to expose the opening 25 and installs or detaches the process cartridge 1 in or from the main casing 22 via the opening 25.

7. Effects (1) According to the process cartridge 1, as depicted in FIG. 1, the developing cartridge handle 76 of the developing cartridge 3 is positioned behind the drum cartridge handle 50 and is spaced apart from the drum cartridge handle 50 in the state where the developing cartridge 3 is installed in the drum cartridge 2.

This configuration may enable the operator to insert his/her fingers between the developing cartridge handle 76 and the drum cartridge handle 50 and readily hold the developing cartridge handle 76 of the developing cartridge 3 for detaching the developing cartridge 3 from the drum cartridge 2.

The upper edge of the drum cartridge handle 50 is located at substantially the same position as the upper edge of the developing cartridge handle 76 in the upper-lower direction in the state where the developing cartridge 3 is installed in the drum cartridge 2.

The developing cartridge handle 76 of the developing cartridge 3 therefore may not greatly protrude upward relative to the drum cartridge handle 50 of the drum cartridge 2.

Consequently, the size of the process cartridge 1 may be reduced in the upper-lower direction while accessibility to the developing cartridge 3 is ensured.

(2) According to the process cartridge 1, as depicted in FIG. 6, the developing cartridge handle 76 and the drum cartridge handle 50 face each other in the state where the developing cartridge 3 is installed in the drum cartridge 2.

That is, the developing cartridge handle 76 is located at substantially the same position as the drum cartridge handle 50 in the right-left direction.

This configuration may, therefore, ensure accessibility to the developing cartridge handle 76 as well as accessibility to the drum cartridge handle 50.

(3) According to the process cartridge 1, as depicted in FIG. 3, the recess portion 51 of the drum cartridge handle 50 is recessed downward than the upper surface of the drum cartridge handle 50 and is open to the rear.

This configuration may, therefore, enable the operator to insert his/her fingers into between the developing cartridge handle 76 and the drum cartridge handle 50 via the recess portion 51 for detaching the developing cartridge 3 from the drum cartridge 2.

Consequently, the configuration may enable the operator to hold the developing cartridge handle 76 readily.

(4) According to the process cartridge 1, as depicted in FIG. 5, the developing cartridge handle 76 includes the upper plate 77 that extends in the right-left direction and the side plates 78 that extend downward from the right and left end portions, respectively, of the upper plate 77.

That is, the upper plate 77 extends in the direction perpendicular to the direction that the side plates 78 extend.

This configuration may, therefore, enable the upper plate 77 to reduce or prevent deformation of the side plates 78 while enabling the side plates 78 to reduce or prevent deformation of the upper plate 77.

Consequently, the stiffness of the entire developing cartridge handle 76 may be ensured, thereby enabling the operator to hold the developing cartridge handle 76 stably.

(5) According to the process cartridge 1, as depicted in FIG. 1, the rib portion 62 of the strengthening rib 61 of the drum frame 31 is positioned below the side plates 78 in the state where the developing cartridge 3 is installed in the drum cartridge 2.

With this configuration, therefore, even if the process cartridge 1 is deformed due to application of an excessive pressing force during the installation of the developing cartridge 3 into the drum cartridge 2, the side plates 78 may come into contact with the rib portion 62, thereby restricting further deformation of the process cartridge 1.

This configuration may therefore prevent breakage of the process cartridge 1 when the excessive pressing force is applied on the process cartridge 1.

(6) According to the process cartridge 1, as depicted in FIG. 1, the bottom wall of the recess portion 51 and the upper plate 77 both extend on an upward and forward inclination.

This configuration may, therefore, provide clearance between the bottom wall of the recess portion 51 and the upper plate 77, thereby enabling the operator to hold the developing cartridge handle 76 further readily.

(7) According to the process cartridge 1, as depicted in FIG. 7C, the upper plate 77 of the developing cartridge 3 that is located at the non-restricted position is located at the position higher than the upper plate 77 of the developing cartridge 3 that is located at the restricted position.

This configuration may, therefore, enable the operator to hold the developing cartridge handle 76 further readily when the developing cartridge 3 is located at the non-restricted position.

(8) According to the process cartridge 1, as depicted in FIG. 6, there is clearance between the front wall 73 of the developing cartridge 3 and the front wall 37 of the drum cartridge 2 throughout the right-left direction.

This configuration may, therefore, enable the operator to hold the developing cartridge handle 76 without restraint using the clearance provided throughout the right-left direction.

(9) According to the process cartridge 1, as depicted in FIG. 6, the pressing members 44 are disposed between the front wall 73 of the developing cartridge 3 and the front wall 37 of the drum cartridge 2.

This configuration may, therefore, enable the operator to visually observe the condition of the pressing members 44 that are pressing the developing cartridge 3.

Consequently, the developing cartridge 3 may be surely pressed by the pressing members 44.

(10) According to the process cartridge 1, as depicted in FIG. 6, the connecting portions 63 of the strengthening rib 61 are disposed between the front wall 73 of the developing cartridge 3 and the front wall 37 of the drum cartridge 2.

With this configuration, the drum frame 31 may be reinforced through the use of the space provided between the front wall 73 of the developing cartridge 3 and the front wall 37 of the drum cartridge 2.

As depicted in FIG. 3, the pressing-member supporting portions 43 are disposed at the respective positions more outside than the strengthening rib 61 in the right-left direction.

With this configuration, in the drum frame 31, the pressing members 44 may be supported by the respective portions reinforced by the strengthening rib 61, thereby allowing the pressing members 44 to slide stably.

As depicted in FIG. 3, of the plurality of connecting portions 63, the one or more connecting portions 63 that are disposed more outside than the drum cartridge handle 50 in the right-left direction each have the upper edge portion that are inclined downward toward the rear.

With this configuration, the developing cartridge 3 may be attached to the drum cartridge 2 smoothly along the inclination of the upper end portions of the connecting portions 63.

8. Variations

In the illustrative embodiment, the photosensitive drum 4 is adopted as the image carrying member. Nevertheless, in other embodiments, the image carrying member may include a photosensitive belt as well as the photosensitive drum 4.

In the illustrative embodiment, the developing roller 7 is adopted as the developing agent carrying member. Nevertheless, in other embodiments, the developing agent carrying member may include a developing sleeve, a developing belt, and a brush roller as well as the developing roller 7.

What is claimed is:

1. A process cartridge comprising:

an image carrying member cartridge comprising:

an image carrying member configured to rotate; and a first frame configured to support the image carrying member at one end portion of the first frame in a first direction perpendicular to an axial direction of the image carrying member, and comprising a pressing member having a rear face oriented towards the one end portion of the first frame in the first direction, the first frame also comprising a first front wall at another end portion of the first frame in the first direction, wherein the first front wall is oriented along the axial direction at an outermost end of the another end portion of the first frame in the first direction and includes a first handle having a first inclined surface inclined with respect to both the first direction and a second direction, the second direction being perpendicular to the axial direction and perpendicular to the first direction, the first inclined surface extending in the axial direction; and a developing cartridge configured to be attached to the image carrying member cartridge via an urging force applied by the pressing member in the first direction, the developing cartridge comprising:

a developing agent carrying member; and a second frame configured to support the developing agent carrying member at one end portion of the second frame in the first direction, and comprising a second front wall at another end portion of the second frame in the first direction, wherein the second front wall is oriented along the axial direction at an outermost end of the another end portion of the second frame in the first direction and includes a second handle, the first inclined surface of the first handle facing the second handle, and wherein in a state where the developing cartridge is attached to the image carrying member cartridge:

the first inclined surface of the first handle is located at substantially the same position as the second handle with respect to the second direction;

the second handle is spaced apart from the first handle in the first direction; and at least a portion of the rear face of the pressing member is disposed, in the first direction, between an outermost front edge of the second front wall and an outermost front edge of the first front wall.

2. The process cartridge according to claim 1, wherein the second handle faces the first handle.

3. The process cartridge according to claim 2, wherein the first handle has a recess portion that is recessed further than an edge of the first handle in the second direction and is open in the second direction.

4. The process cartridge according to claim 3, wherein the second handle comprises:

a first wall extending along the axial direction; and a plurality of second walls extending in the second direction from both end portions of the first wall in the axial direction.

5. The process cartridge according to claim 4, wherein the first frame further comprises a rib portion that is positioned in the second direction relative to the plurality of second walls in the state where the developing cartridge is attached to the image carrying member cartridge.

6. The process cartridge according to claim 4, wherein the first wall is inclined, and wherein the recess portion comprises a bottom wall that is inclined in the same direction as the direction that the first wall is inclined.

7. The process cartridge according to claim 4, wherein the first frame further comprises a regulating member configured to move between:

a restricting position at which the regulating member restricts separation of the developing cartridge attached to the image carrying member cartridge from the first frame; and a non-restricting position at which the regulating member does not restrict the separation of the developing cartridge attached to the image carrying member cartridge from the first frame, wherein the developing cartridge is configured to move between:

a restricted position at which the developing cartridge is restricted from being separated from the first frame by the regulating member, and a non-restricted position at which the developing cartridge is not restricted to be separated from the first frame, wherein when the developing cartridge is located at the restricted position, an edge of the first wall in the second direction is located at substantially the same position as the edge of the first handle in the second direction with respect to the second direction, and wherein when the developing cartridge is located at the non-restricted position, an edge of the first wall in the second direction is positioned more distant from the edge of the first handle in the second direction than the edge of the first handle in the second direction when the developing cartridge is located at the restricted position.

8. The process cartridge according to claim 1, wherein the another end portion of the second frame in the first direction is positioned in the first direction relative to the another end portion of the first frame in the first direction while clearance is left therebetween throughout the axial direction.

9. The process cartridge according to claim 1, wherein the first frame further comprises a strengthening portion for strengthening the first frame, wherein, as viewed in the second direction, the strengthening portion is disposed such that the strengthening portion is positioned between the another end portion of the second frame in the first direction and the another end portion of the first frame in the first direction.

10. The process cartridge according to claim 1, wherein in the state where the developing cartridge is attached to the image carrying member cartridge, the second frame at the another end portion of the second frame in the first direction where the second handle is disposed is spaced apart by a first distance from the first frame at the another end portion of the first frame in the first direction, and the second frame at the another end portion of the second frame in the first direction is spaced apart by a second distance from the first frame at the another end portion of the first frame in the first direction, and wherein the first distance is less than the second distance.

11. The process cartridge according to claim 1, wherein the second handle has a second inclined surface configured to overlap with the first inclined surface of the first handle as viewed in a horizontal direction and to face away from the first inclined surface of the first handle.

12. The process cartridge according to claim 1, wherein the first inclined surface of the first handle is disposed only on a central part of the first handle with respect to the axial direction.

13. The process cartridge according to claim 1, wherein among distances between the first handle and the second handle in the first direction, a distance between the first inclined surface of the first handle and the second handle is greatest.

* * * * *